US007896582B2

(12) United States Patent
Chouery

(10) Patent No.: US 7,896,582 B2
(45) Date of Patent: Mar. 1, 2011

(54) RETAINING WALL

(75) Inventor: Farid A. Chouery, Seattle, WA (US)

(73) Assignee: FAC Systems Inc., Seattle, WA (US)

( * ) Notice: Subject to any disclaimer, the term of this patent is extended or adjusted under 35 U.S.C. 154(b) by 0 days.

(21) Appl. No.: 12/404,097

(22) Filed: Mar. 13, 2009

(65) Prior Publication Data

US 2009/0232608 A1 Sep. 17, 2009

Related U.S. Application Data

(60) Provisional application No. 61/036,859, filed on Mar. 14, 2008.

(51) Int. Cl.
*E02D 29/02* (2006.01)

(52) U.S. Cl. ..... 405/286; 405/262

(58) Field of Classification Search ..... 405/262, 405/284–286

See application file for complete search history.

(56) References Cited

U.S. PATENT DOCUMENTS 5,468,098 A * 11/1995 Babcock ..... 405/262
5,697,736 A * 12/1997 Veazey et al. ..... 405/284
6,494,009 B1 * 12/2002 Kang ..... 52/575

FOREIGN PATENT DOCUMENTS

JP 61134434 A * 6/1986

* cited by examiner

*Primary Examiner* — Sunil Singh
(74) *Attorney, Agent, or Firm* — Christensen O'Connor Johnson Kindness PLLC

(57) ABSTRACT

A retaining wall or a counterfort retaining wall incorporates a vertical stem wall section, a base section having a toe, a heel, and a number of shallow piles at the bottom of the base section to improve the sliding and overturning safety factor of the wall. To further improve the sliding and overturning safety factor of the wall, an edge of the heel is slanted with a bevel or a batter with an angle to pick up more resisting load.

14 Claims, 10 Drawing Sheets

RETAINING WALL

CROSS-REFERENCE TO RELATED APPLICATION

This application claims the benefit of U.S. Provisional Application No. 61/036,859, filed Mar. 14, 2008, which is herein incorporate by reference.

FIELD OF THE INVENTION

The present invention relates to retaining walls and counterfort retaining walls.

BACKGROUND

In many wall designs, such as retaining walls or counterfort retaining walls or flood walls, the site parameters dictate the final design of the wall. In many cases there is also a property line that abuts the wall and moving the wall as close as possible to the property line is desirable. The retaining wall of the present invention gives the designer the ability of doing so. In addition, the embodiments of the retaining wall disclosed can be designed to have less concrete and backfill and thus may be more economical to construct.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

To address the problems discussed above, a retaining wall or a counterfort retaining wall includes a vertical stem wall section and a base section at the bottom of the stem. The base section has a heel portion and a number of piles that extend downwardly from the bottom of the base. In one embodiment, the heel is beveled. In another embodiment, the piles are replaced with a key that runs continuously along the bottom of the base section. In yet another embodiment, the base section has a toe portion that extends outwardly from the stem wall.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
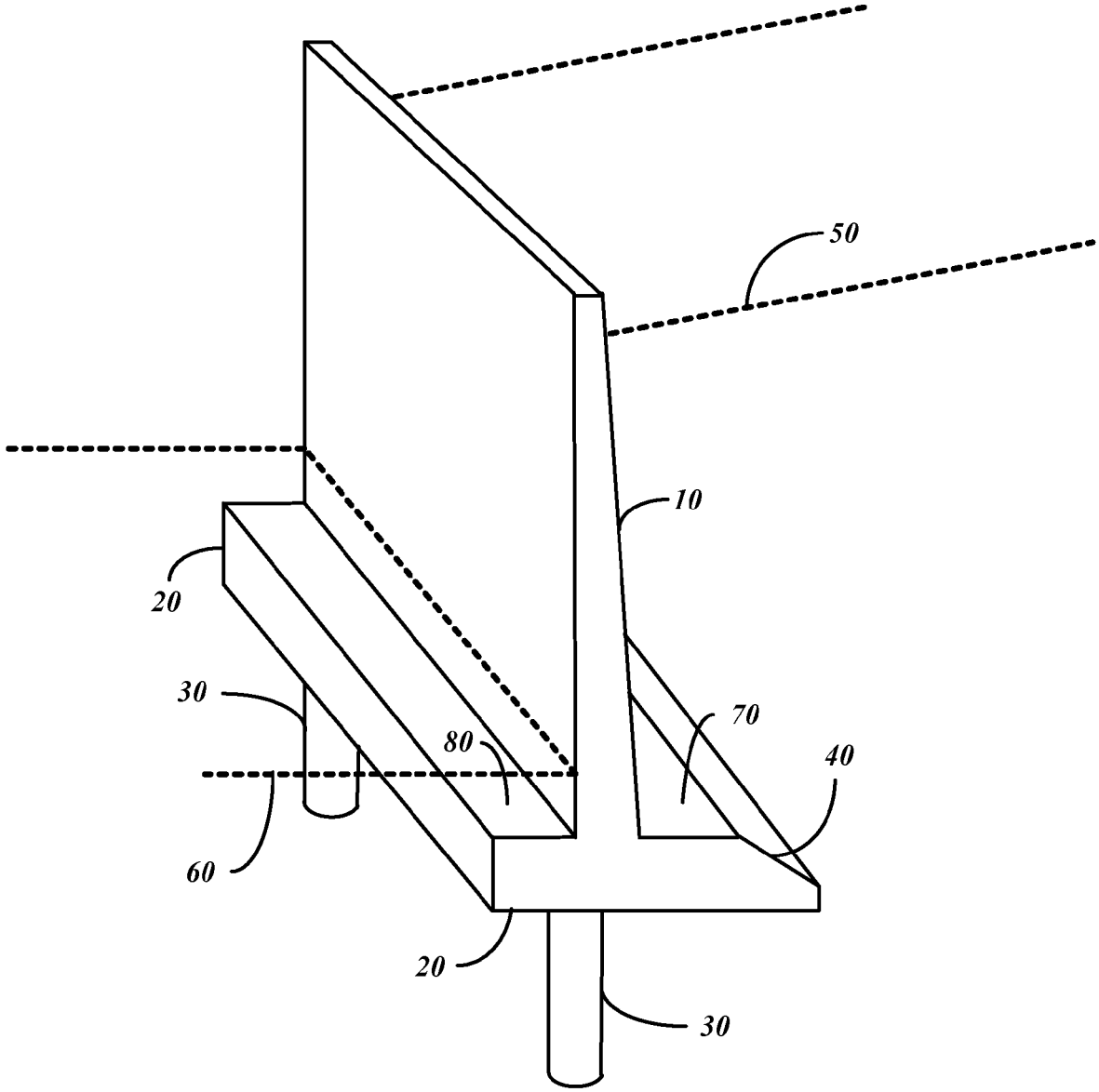
FIG. 1 is an isometric view of an embodiment of a retaining wall in accordance with the present invention.
Figure 2:
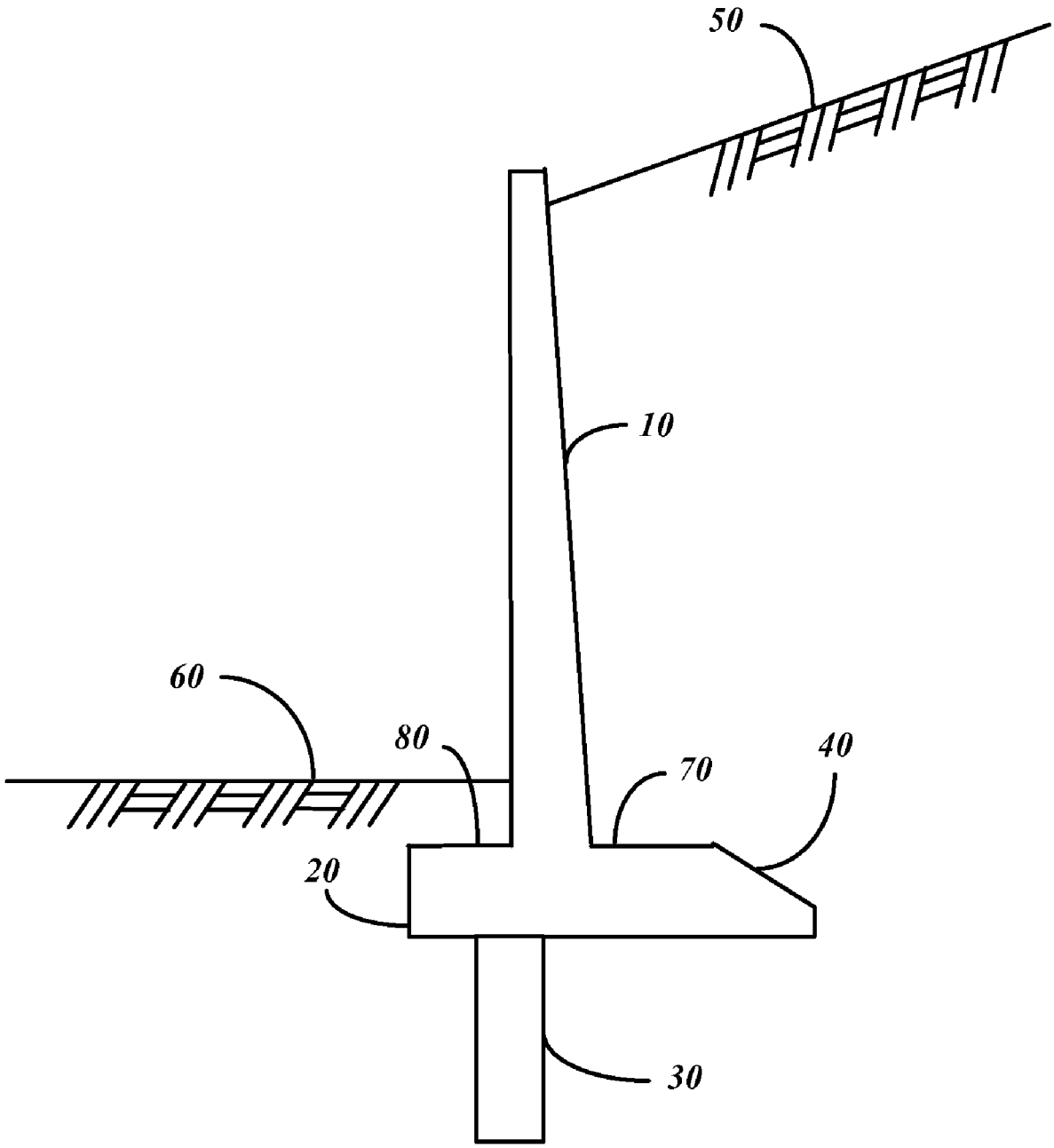
FIG. 2 illustrates a cross-section of the retaining wall shown in FIG. 1.
Figure 3:
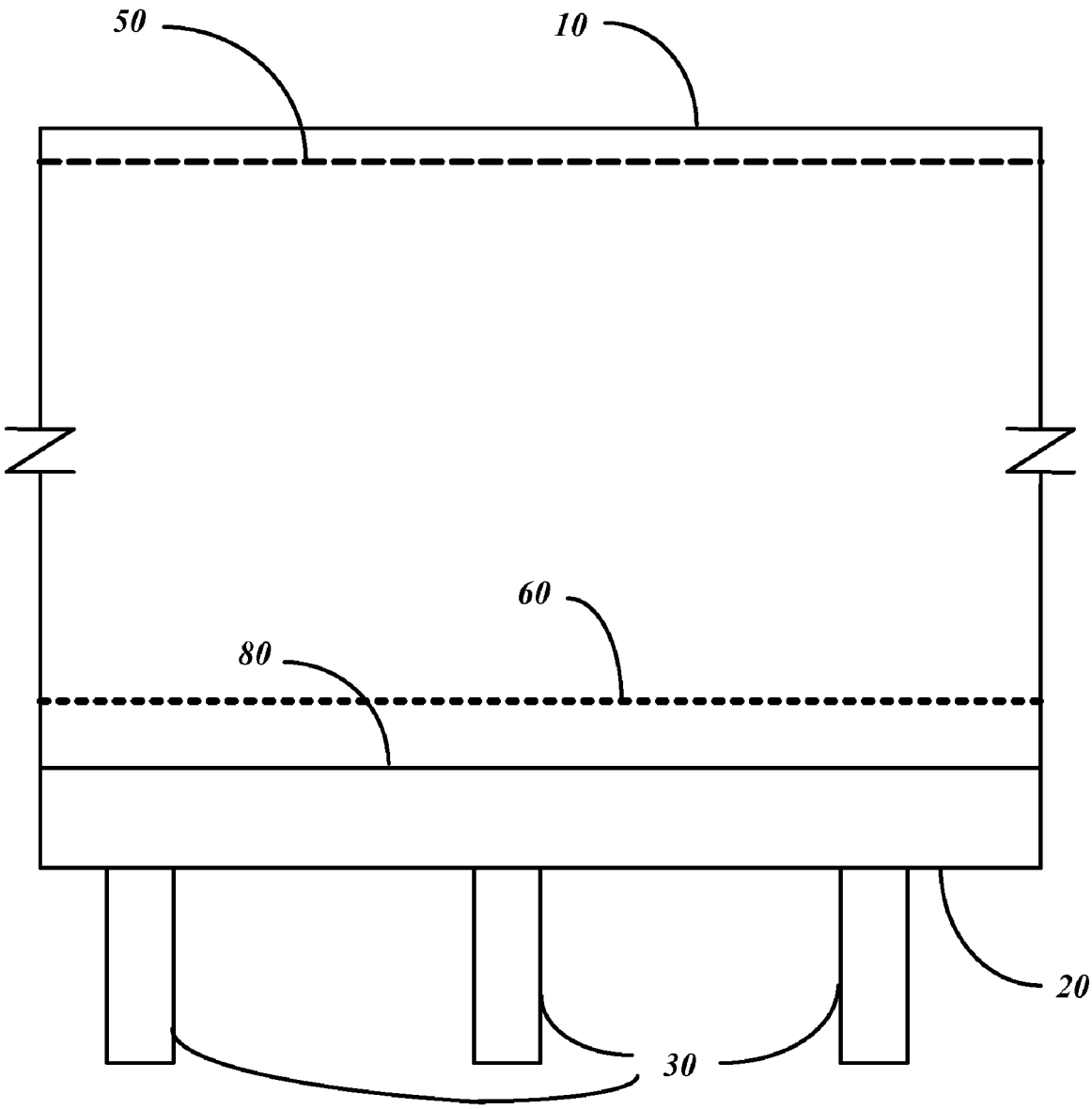
FIG. 3 illustrates a front face elevation of retaining wall shown in FIG. 1.

FIGS. 1, 2 and 3 show one embodiment of a retaining wall according to the present invention. A retaining wall includes a non-prismatic stem wall 10 and a base section 20 that is positioned below the stem wall. The base section has a width that is wider than the width of the stem wall. In the embodiment shown, the base section also has a toe portion 80 and a heel portion 70. Extending downwardly from the base section 20 is a number of shallow piles 30. In one embodiment, the base section has a bevel 40 positioned on its upper outside edge that engages the backfill. The retaining wall supports a sloped backfill 50 behind the stem wall and a level backfill 60 is placed in front of the stem wall. In the embodiment disclosed, the piles have a length that is generally 10 feet long or less and that are approximately 2 to 24 inches in diameter, depending on soil conditions.

Figure 4:
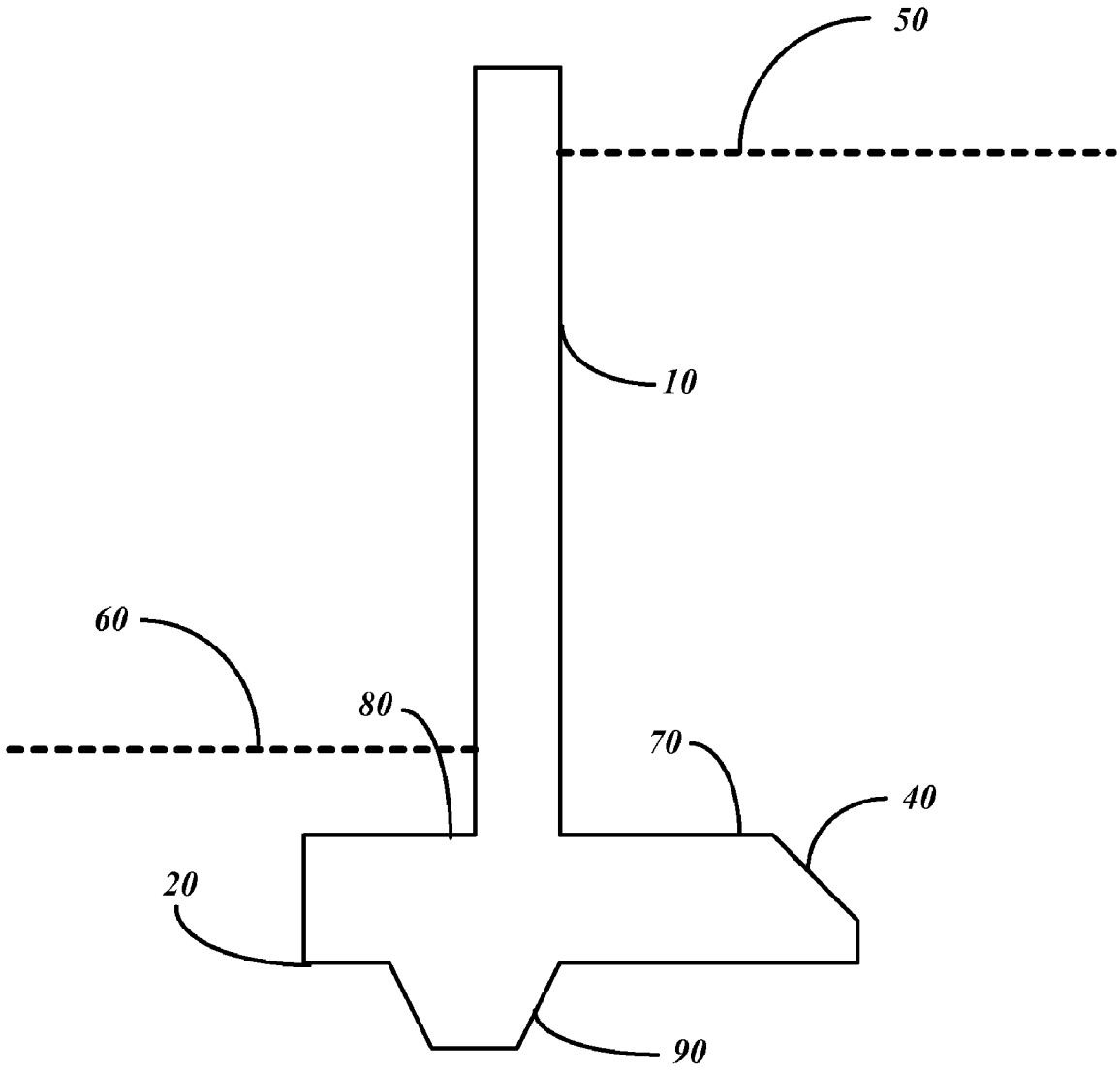
FIG. 4 illustrates an embodiment of retaining wall shown in FIG. 2 with a key option instead of piles.

FIG. 4 shows another embodiment of the present invention with a continuous beveled key 90 extending along the bottom of the base section instead of the shallow piles.

Figure 5A:
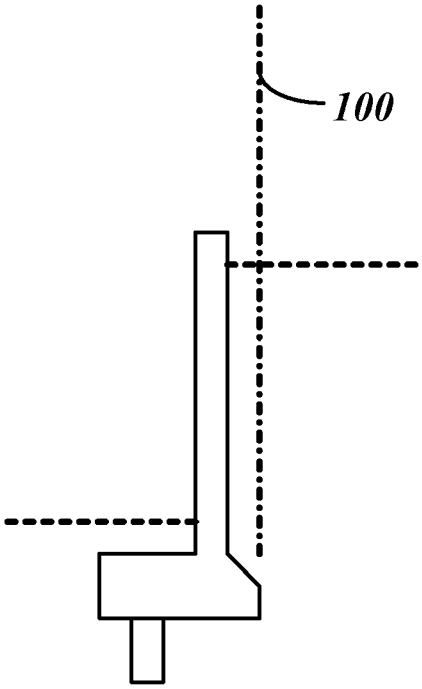
FIGS. 5A, 5B, 5C, and 5D illustrate different embodiments of a retaining wall with their corresponding location relative to a property line.
Figure 5B:
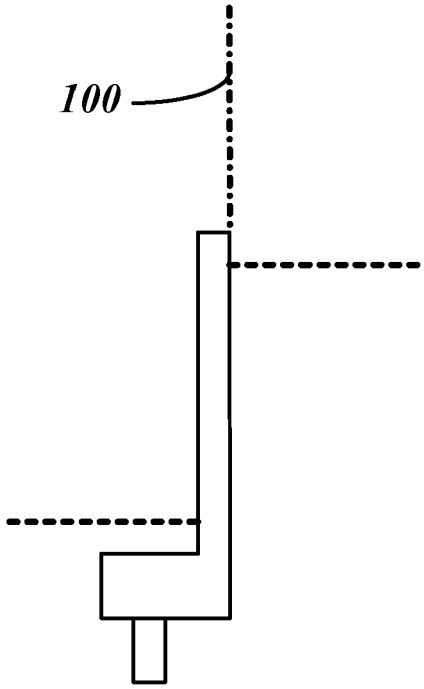
Figure 5C:
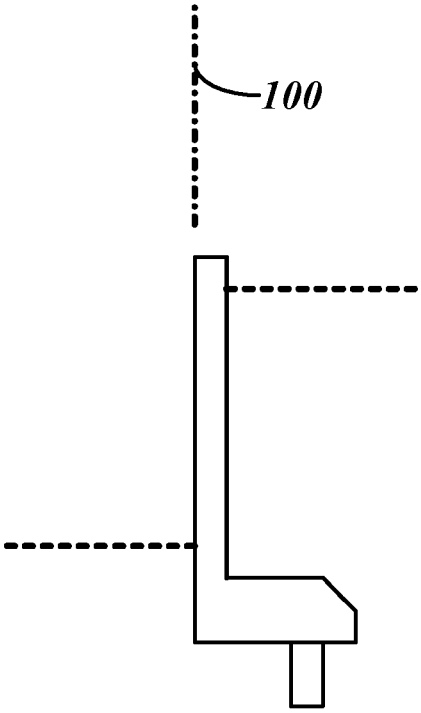
Figure 5D:
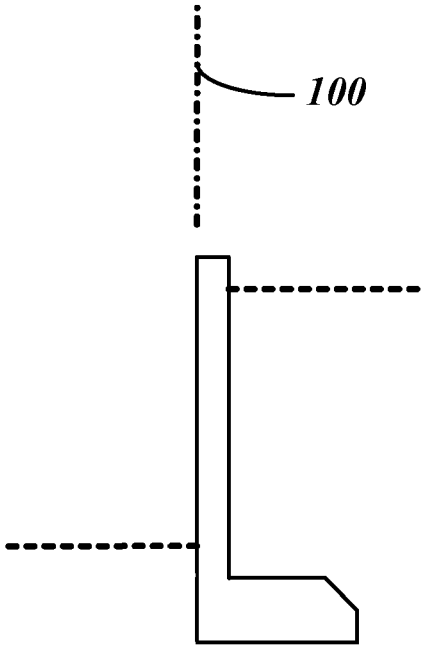

FIGS. 5A, 5B, 5C, and 5D show several optional embodiments of the present retaining wall invention and their corresponding location relative to property line 100. In FIG. 5A, the toe portion is wider than the heel portion such that the wall stem is nearer the beveled edge of the heel portion than a front edge of the toe portion. In FIG. 5B, the retaining wall lacks a heel portion and simply includes a toe portion that extends horizontally outwards from the stem wall section. A number of shallow piles extend downwardly from the toe portion. Conversely, in FIG. 5C, the retaining wall lacks a toe portion but has a heel portion with a beveled edge. The exposed face of the stem wall is generally aligned with the property line. In FIG. 5D, the retaining wall lacks both a toe portion and the shallow piles.

Figure 6:
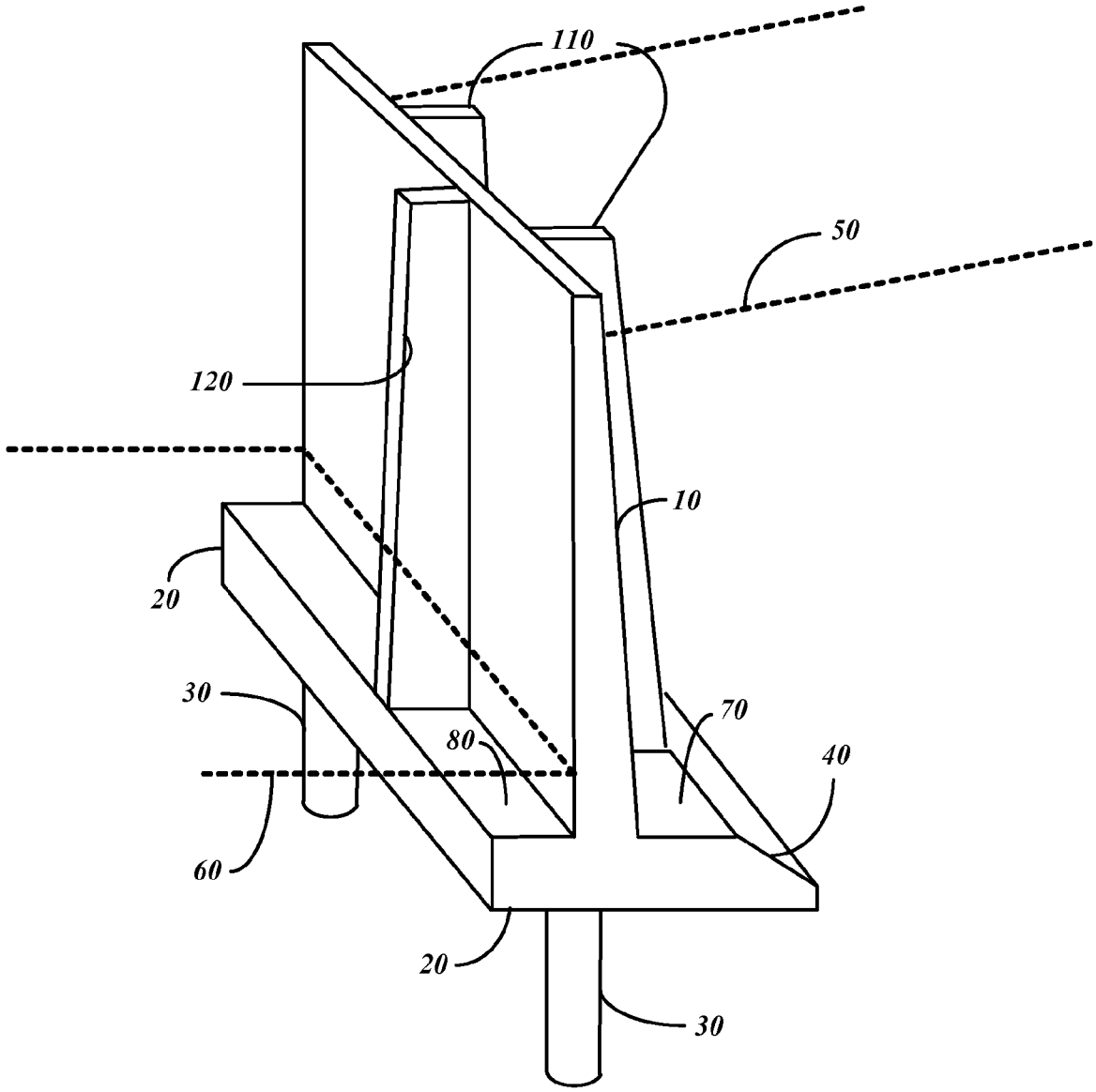
FIG. 6 is an isometric view of an embodiment of a counterfort retaining wall in accordance with the present invention.

FIG. 6 shows one embodiment of a counterfort retaining wall according to the present invention. A counterfort retaining wall includes a non-prismatic stem wall 10 and a base section 20 that is positioned below the stem wall. The supporting intermediate non-prismatic column beams 110 and 120 support the stem and the base as shown in both sides of the stem wall. It is optional to use the supporting beams 110 only or 120 or both on either side of the stem. The base section has a width that is wider than the width of the stem wall. In the embodiment shown, the base section also has a toe portion 80 and a heel portion 70. Extending downwardly from the base section 20 is a number of shallow piles 30. In one embodiment, the base section has a bevel 40 positioned on its upper outside edge that engages the backfill. The retaining wall supports a sloped backfill 50 behind the stem wall and a level backfill 60 is placed in front of the stem wall. In the embodiment disclosed, the piles have a length that is generally 10 feet long or less and that are approximately 2 to 24 inches in diameter, depending on soil conditions.

The description provided below provides one exemplary methodology for calculating the wall dimensions. As will be appreciated by those skilled in the art, the dimensions are affected by soil type and expected loads on the wall. Therefore other methods may be used in calculating the wall dimensions. In the embodiments described, the retaining wall is formed of steel reinforced concrete. The retaining wall illustrations in FIGS. 7-10 are not shown to scale.

In the exemplary calculations provided below, the principals of soil mechanics as described in the Concrete Reinforcing Steel Institute Design Handbook CRSI 2002 are used. A retaining wall with a prescribed earth pressure due to a sloped backfill is to be designed. The pressure due to the bevel has a different active coefficient and the passive pressure on the pile is assumed to increase from the passive wedge due to the friction and cohesion at the side of the wedge. These changes in the pressures are primarily what constitute the success of the retaining wall design disclosed. Historically these new pressure interactions along with the geometrical changes in this invention were not observed or, if assumed, they were then dismissed without actually having a close look on this phenomenon. Piles and battered piles have been used in the past with retaining walls for axial loads and moments. However, shallow piles were not used because designers preferred using a key not realizing the advantages of using shallow piles.

Figure 7:
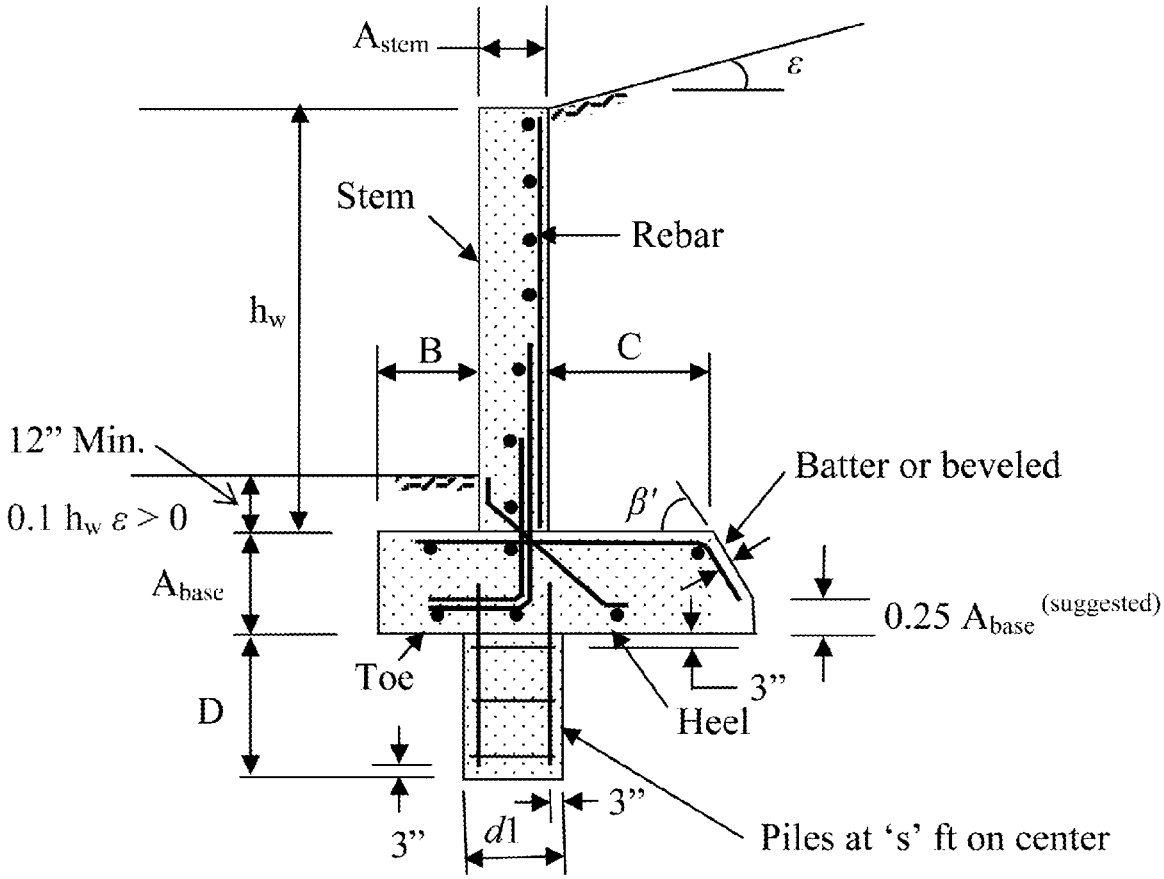
FIG. 7 illustrates one embodiment of a retaining wall using a bevel on the heel portion and a number of shallow piles.

The given description is of wall backfilled with cohesiveless such as sand and gravel backfill that are commonly used. The stem wall is assumed prismatic. The description of the wall shown in FIG. 7 is such that the dimension $A_{base}$ is the base dimension and can be anything but zero. The dimension $A_{stem}$ is the stem dimension and can be any distance but zero. The dimension B is the dimension of the toe and can be any distance including zero. The dimension C is the dimension of the heel and can be any distance including zero. The dimension D is the depth of the piles and can be any distance including zero. The dimension d1 is the diameter of the pile and can be any distance. Also, one can substitute the piles with a standard key FIG. 8, where K is the distance of the key and t is the width of the key. The location of the piles and of the key can be in anyplace at the bottom of the base. Additionally, the piles can be battered if more resistance is needed. The angle β' can be anything smaller or equal to 90 degrees. For a counterfort retaining wall that includes columns or vertical beams that support the stem and incorporates the beveled angle β' can be with or without a shallow pile can be analyzed similarly. The angle ϵ can be from −90 degrees to ϕ, where ϕ is the internal friction angle of the soil. For other types of backfill different analysis is needed. However, the following principals can be used as a guide for other conditions.

Figure 8:
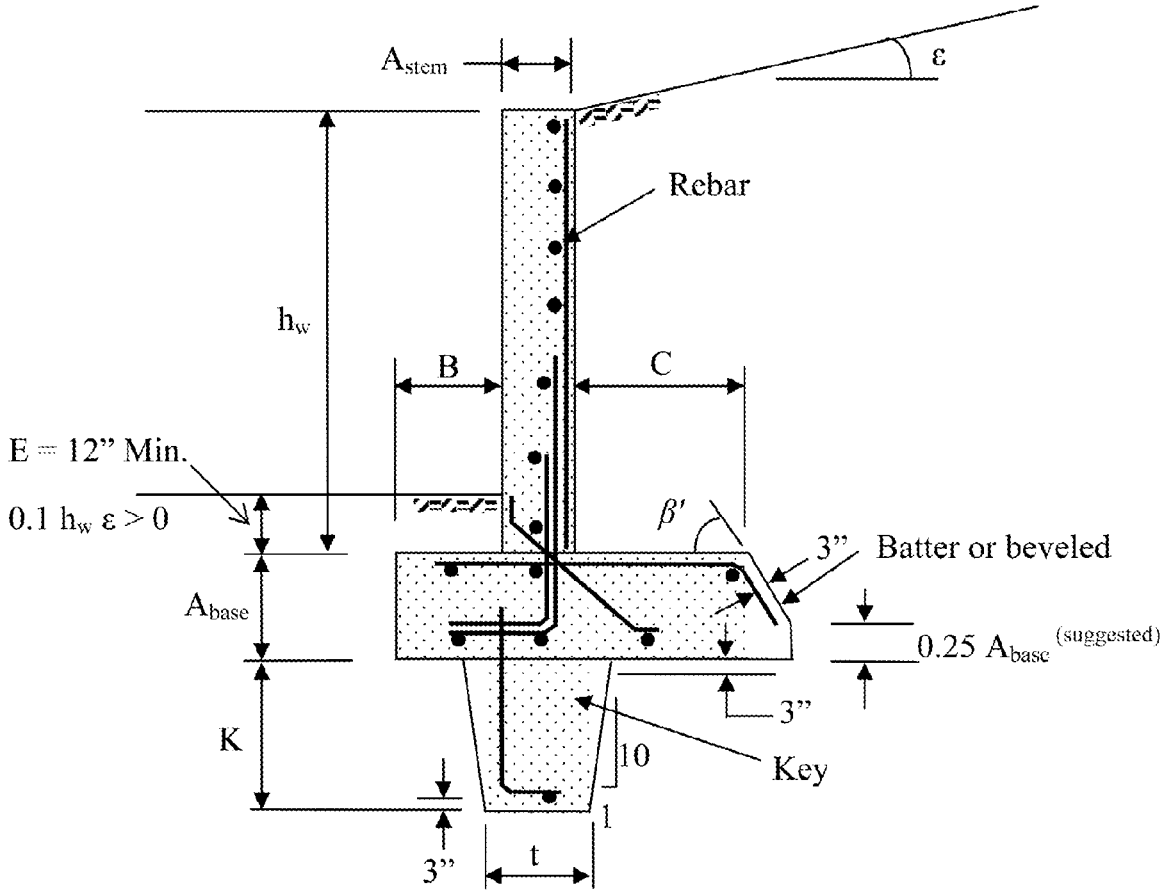
FIG. 8 illustrates another embodiment of a retaining wall using the bevel on the heel portion and a key.
Figure 9:
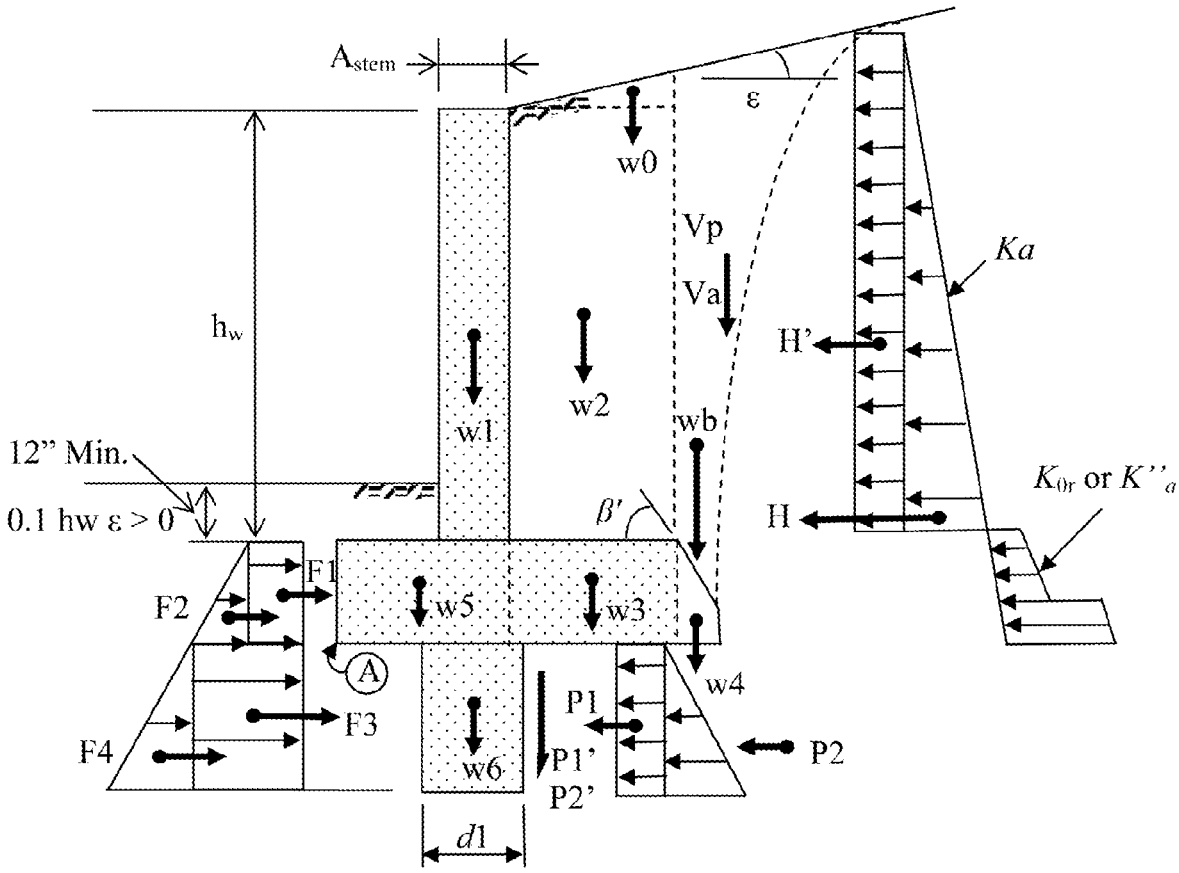
FIG. 9 is a pressure diagram showing forces and weights encompassing the retaining wall shown in FIG. 7.
Figure 10:
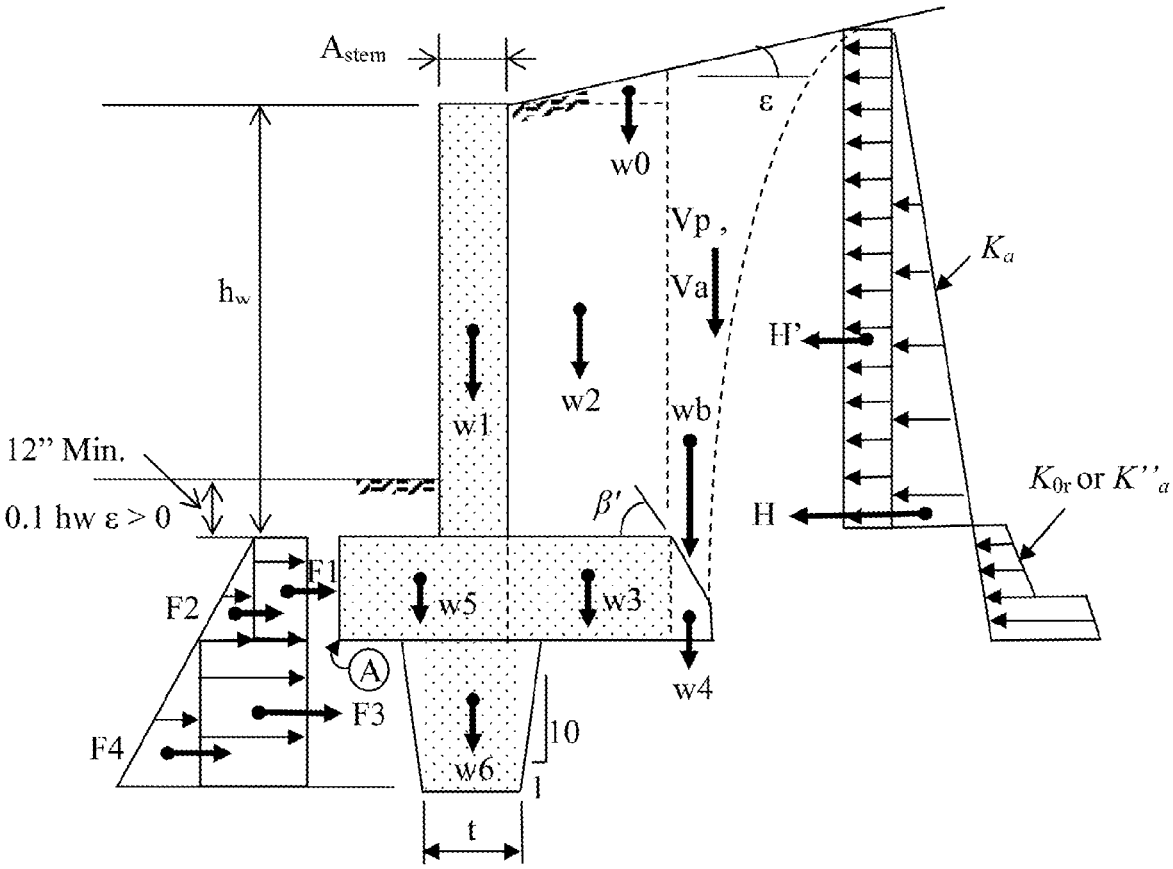
FIG. 10 is a pressure diagram showing forces and weights encompassing the retaining wall shown in FIG. 8.

FIGS. 9 and 10 show the pressure diagram and the weights on the retaining walls of FIGS. 7 and 8, respectively.

The analysis can vary depending on how the pressure is treated at the bevel. Active pressure can be used at reset pressure can be used or uplift pressure can be used. In all conditions the stability can be shown to improve from a normal retaining wall. It will be demonstrated the case for active pressure for a pile and a key.

β=180−β'=bevel angle
α=local slip surface at the bevel
ϕ=internal friction angle of the soil
δ=concrete friction angle with soil at bevel
γ=unit weight of soil
c=the cohesion below the base
Let:

$$\frac{n}{m} = \frac{\sin(\beta - 90 - \phi)}{\cos(\beta - 90 - \phi)} = \tan(\beta - 90 - \phi)$$

u=tan ϕ+tan δ
v=(tan ϕ+tan δ) tan(β−90−ϵ)+1−tan ϕ tan δ
w=(1−tan ϕ tan δ)tan(β−90−ϵ)

$$\tan\alpha = -\frac{n}{m} + \sqrt{\left(\frac{n}{m}\right)^2 + \frac{w}{u} - \left(\frac{n}{m}\right)\left(\frac{v}{u}\right)}$$

$$f = \frac{\sin(\beta - 90) + \cos(\beta - 90)\tan(\alpha - \phi)}{[1 + \tan\delta\tan(\alpha - \phi)][\tan\alpha + \tan(\beta - 90 - \beta)]\cos^2(\beta - 90)}$$

$$g = \frac{[\sin(\beta - 90) + \cos(\beta - 90)\tan(\alpha - \phi)]\cos\varepsilon}{[1 + \tan\delta\tan(\alpha - \phi)][\tan\alpha + \tan(\beta - 90 - \varepsilon)]\cos(\beta - 90 - \varepsilon)\cos(\beta - 90)}$$

Then:

$$K_{ba} = 0.5f\begin{bmatrix}\sin(\beta - 90) + \\ \cos(\beta - 90) \\ \tan\delta\end{bmatrix}\frac{.075A_{base}}{h_1 - 0.375A_{base}} + g\begin{bmatrix}\sin(\beta - 90) + \\ \cos(\beta - 90) \\ \tan\delta\end{bmatrix}$$

$$K_a'' = \frac{0.5f\begin{bmatrix}\cos(\beta - 90) - \\ \sin(\beta - 90)\tan\delta\end{bmatrix}(0.75A_{base})^2 + g\begin{bmatrix}\cos(\beta - 90) - \\ A_r\sin(\beta - 90)\tan\delta\end{bmatrix}(h_1 - .75A_{base})(0.75A_{base})}{0.5(0.75A_{base})^2 + 0.75A_{base}(h_1 - .75A_{base})}$$

$$N(\text{for cohesiveless soil}) = 1 + \left(\frac{4K_0\tan\phi}{3}\right)\left(\frac{D}{d1}\right)$$

$$N(\text{for cohesiveless soil}) = 1 + \left[\frac{2\frac{c}{\gamma D}}{1 + 4\left(\frac{c}{\gamma D}\right)}\right]\left(\frac{D}{d1}\right)$$

Where,
$h_1=h_w+C \tan \epsilon+0.375 A_{base}(1+\tan \epsilon/\tan \beta')$
$h''=h_w+C \tan \epsilon+A_{base}+0.75 A_{base} \tan \epsilon/\tan \beta'$
$h_0=h_w+C \tan \epsilon+0.75 A_{base} \tan \epsilon/\tan \beta'$
$h_a=E+A_{base}+0.5(h_0-E)$
$\gamma_c$=unit weight of concrete
N=Number of diameters the pile passive can increase
μ=Coefficient of friction between soil and concrete at the bottom of the base
$K_a$=Active pressure coefficient using standard soil mechanics pressure
$K''_a$=Active pressure coefficient at bevel at heel
$K_p=\tan^2 (45+\phi/2)$=Passive pressure coefficient assumed cohesion-less
$K_0=1.06 (1-\sin \phi)$=At rest pressure coefficient at level
p=Surcharge pressure
$w0=\text{Sloped Backfill}=0.5\gamma C^2 \tan \epsilon$
$w1=\text{Wall}=A_{stem}h_w\gamma_c$
$w2=\text{Backfill}=Ch_w\gamma$
$w3=\text{Base}=A_{base}C\gamma_c$
$w4=(15/32)(A_{base})^2\gamma_c \cot \beta'$
$w5=\text{Base}=A_{base}(B+A_{stem})\gamma_c$
$w6=\text{Pile}=(\pi/4)(d^2)D(\gamma_c)(d1/s)$
$w6=\text{Key}=K(t+K/10)\gamma_c$
$wb=0.75 K_{ba}\gamma A_{base}(h_1)$
$Vp=ph'' \tan \epsilon$
$Va=0.5K_a\gamma(h'')^2 \tan \epsilon$
$P1=K_a\gamma h''D^2N(d1/s)(\pi/4)$
$P2=0.5 K_aD^2N(d1/s)(\pi/4)$
$P1'=[2K_0\gamma h_aD(d1/s)(\pi/4)+P1/N]\mu$
$P2'=[K_0\gamma D^2(d1/s)(\pi/4)+P2/N)]\mu$ $W_T$=Pile=w0+w1+w2+w3+w4+w5+w6+wb+Vp+Va+P1+P2+P1'+P2'

$W_T$=Key=w0+w1+w2+w3+w4+w5+w6+wb+Vp+Va

Taking Moments at point A of w0, w1, w2, w3, w4, w5, w6, wb, Vp, Va, P1, P2, P1', P2' with respective moment arm gives $M_T$.

Acting Force and Moment:

$H=0.5K_a\gamma(h_0)^2+0.75K''_1\gamma h_1 A_{base}+p(h_0+A_{base})+0.25\ K_a\gamma(h_0+0.875\ A_{base})A_{base}$ $M_0=K_a\gamma(A_{base}+h_0/3)(h_0)^2/2+0.75K''\ K''_{\phi}\gamma h\ h_{\phi}A_{base}(0.875\ A_{base})+0.5p(h_0+A_{base})+0.25\ K_a\gamma(h_0+0.875\ A_{base})A_{base}(0.125\ A_{base})$ Passive Pressure:

$F1=K_p\gamma EA_{base}$ $F2=0.5\ K_p\gamma(A_{base})^2$ $F3=Pile=K_p\gamma[(E+A_{base})DN(d1/s)$ $F3=Key=K_p\gamma[(E+A_{base})K$ $F4=Pile=0.5\ K_p\gamma K^2N(d1/s)$ $F4=Key=0.5\ K_p\gamma K^2$

F=F1+F2+F3+F4

Sliding Safety Factor=SSF=[$\mu W_T$+F]/H

Over turning safety Factor=OTSF=$M_T/M_0$

For the case of at rest pressure at the bevel when assuming zero deflection at the base we have:

$$K''_0 - (\cos^2\beta + K_{0r}\sin^2\beta)\left[1 + \cot\beta\left(\tan\delta - \frac{\tan\beta(1-K_{0r})}{1+K_{0r}\tan^2\beta}\right)\right]$$

$$K_{b0} = (\cos^2\beta + K_{0r}\sin^2\beta)\left[-\cot\beta + \tan\delta - \frac{\tan\beta(1-K_{0r})}{1+K_{0r}\tan^2\beta}\right]$$

$$K_{0r} = \frac{\cos^2\phi}{z_0^2 - z_m^2}[A_1(1-z_m^2) - 4A_2(1-z_m) + 2\ln z_0 - 2A_3\ln z_m]$$

$A_1[1+\tan(\phi-\epsilon)\tan\phi]^2$ $A_2=\tan\phi\ \tan(\phi-\epsilon)[1+\tan(\phi-\epsilon)\tan\phi]$ $A_3=\tan^2\phi\ \tan^2(\phi-\epsilon)$ $z_0=1+\sin\phi\sqrt{1-\cot\phi\tan\epsilon}$ $z_m=\sin\phi\sqrt{1-\cot\phi\tan\epsilon}$ Where, $K''_0$=At rest pressure coefficient at bevel at heel $K_{b0}$=Vertical at rest pressure coefficient at bevel at heel $K_{0r}$=At rest coefficient for a sloped backfill Thus replace $K_{ba}$ by $K_{b0}$ in wb above and H and $M_0$ becomes:

$H=0.5K_a\gamma(h_0)^2+0.75K''_0\gamma A_{base}h_1+p(h_0+A_{base})+0.25\ K_0\gamma(h_0+0.875\ A_{base})A_{base}$ $M_0=K_a\gamma(A_{base}+h_0/3)(h_0)^2/2+0.75K''_0\gamma(A_{base})(h_1)(0.875\ A_{base})+0.5p(h_0+A_{base})^2+0.25\ K_0\gamma(h_0+0.875\ A_{base})A_{base}(0.125\ A_{base})$ For the case of uplift analysis in the case of rotation:

$$\frac{\Delta}{\Delta_p} = \frac{1-K_0^2}{(K_p-K_0)}\left[\frac{6(K_u-K_0)(h_w+A_{base})e}{(K_u-K_0)X^2-(1-K_0K_u)(h_w+A_{base})^2}\right]$$

$X=B+A_{stem}+C+0.75\ A_{base}/\tan\beta'$ $x_c=[M_T-M0]/W_T$ $e=X/2-x_c$ $$K_u = -(K_p-K_0)\left(\frac{\Delta}{\Delta_p}\right)^2 + 2(K_p-K_0)\left(\frac{\Delta}{\Delta_p}\right) + K_0$$

$$N_q^l = [-\cot\beta N_q - K_{b0}]\left[\frac{K_u-K_0}{K_p-K_0}\right] + K_{b0}$$

And replace wb by $wb=0.75N^l_q\gamma A_{base}(h_1)$

If, for example, we take a 12-foot retaining wall with level backfill and use a key and design per standard practice we find the required sliding safety factor is SSF=1.5 and the required overturning safety factor is OTSF 2.0 where β'=90 degrees and β=90 degrees. The parameters used are:

$\phi$=30 degrees $\epsilon$=0.0

$\delta$=24.23 degrees $\gamma$=130

$\gamma_c$=150 pcf $\mu$=0.45

Soil reaction=0.75

$K_a$=0.333

$K''_a$=varies depending on β

$K_p$=3.0 c=0.0 p=0.0

$h_w$=12 feet $A_{stem}$=9 inch

E=14.4 inch t=18 inch

K=12 inch

A=12 inch

B=24 inch

C=45 inch

X=78 inch

We find when varying the bevel angle β' for the same retaining wall the following Table 1 for SSF and OTSF is obtained.

| | B' | | | | | | | | | | | |
|---|---|---|---|---|---|---|---|---|---|---|---|---|
| | 90 degrees | | | | 60 degrees | | | | 45 degrees | | | |
| | $K_\alpha$ | Uplift | $K_0$ | Uplift | $K_\alpha$ | Uplift | $K_0$ | Uplift | $K_\alpha$ | Uplift | $K_0$ | Uplift |
| SSF | 1.5 | 1.5 | 1.38 | 1.38 | 1.57 | 2.47 | 1.59 | 2.37 | 1.64 | 3.08 | 1.76 | 3.08 |
| OTSF | 2.18 | 2.18 | 2.15 | 2.15 | 2.46 | 5.59 | 2.63 | 5.37 | 2.98 | 7.42 | 2.93 | 7.48 |

Thus, the stability increases with reducing β'. Where the base is extended 5.2 inches for β'=60 degrees making a concrete volume increase by 1.6% and extended 9 inches for β'=45 degrees making a concrete volume increase 2.8%. So for practically the same amount of concrete we have increased the stability.

From this conclusion, it would be wise to reduce the distance C for a given β' and obtain the required SSF of 1.5 and OTSF of 2.0. This may require changing the key. Additionally, if it is required to reduce the concrete, then using piles is more suitable since the passive pressure increase by N diameters due to the side friction on the passive wedge. Since we are able to reduce C and use piles, we have minimized the volume of concrete and backfill. Furthermore, if the distance C is encroaching to a property line, then we are able to move the wall toward the property line and gain more real estate in front of the wall. In many design practices the property line is a crucial element to avoid in design. To show this finding, we redesign the wall two ways: with a key and with piles.

Using:

$f_y$=60,000 psi for steel reinforcement $f'_c$=3000 psi concrete strength

The original wall has 0.655 cubic yard of concrete per foot and 62.53 lbs. of reinforcing steel per foot. For a redesign with key and $K_0$ condition at the bevel:

β'=36 degrees
$A_{stem}$=9 inch
$A_{base}$=12 inch
K=12 inch
E=14.4 inch
B=24 inch
C=27 inch
X=72.39 inch
t=18 inch
SSF=1.59
OTSF=2.04
SSF Uplift=4.17
OTSF Uplift=8.80
0.602 cubic yard of concrete per foot
59.21 lbs. of reinforcing steel per foot
Savings in concrete=8.14%
Savings in steel=5.31%
Savings in backfill=4.52%

For a redesign with piles at 5 ft. on center and $K_0$, the condition at the bevel for minimum C:

β'=36 degrees
$A_{stem}$=9 inch
$A_{base}$=12 inch
d1=12 inch
D=47 inch
s=5 ft
N=2.6
E=14.4 inch
B=61 inch
C=0 inch
X=82.39 inch
Distance to property line at heel edge=21.39 inch
SSF=1.79
OTSF=2.00
SSF Uplift=3.16
OTSF Uplift=6.15
0.596 cubic yard of concrete per foot
68.48 lbs. of reinforcing steel per foot
Savings in concrete=9%
Additional steel=9.51%
Savings in backfill=21.32%

For a redesign with piles at 5 ft. on center and $K_0$, the condition at the bevel for minimum concrete:

β'=36 degrees
$A_{stem}$=9 inch
$A_{base}$=12 inch
d=12 inch
D=32 inch
s=5 ft
N=2.08
E=14.4 inch
B=14 inch
C=32 inch
X=67.39
SSF=1.79
OTSF=2.02
SSF Uplift=4.38
OTSF Uplift=8.31
0.542 cubic yard of concrete per foot
63.65 lbs of reinforcing steel per foot
Savings in concrete=17.18%
Additional steel=1.8%
Savings in backfill=0.4%

Finally we can observe the results. Note the piles does not need to be concrete piles they can be steel tubing or square tubing of I beams. They can be driven or installed in a hole.

While illustrative embodiments have been illustrated and described, it will be appreciated that various changes can be made therein without departing from the scope of the invention.

The embodiments of the invention in which an exclusive property or privilege is claimed are defined as follows:

1. A retaining wall, comprising:

a vertical stem wall section;

a base section positioned below the vertical stem wall section, wherein the base section includes a heel portion that extends horizontally outwards from the stem wall section and wherein the heel portion has an outer vertical edge at an end of the heel portion and a top surface and a bevel at a top, outer edge thereof, wherein the bevel has a first edge that meets the outer vertical edge of the heel and a second edge on the top surface positioned between the outer vertical edge and the vertical stem wall section; and wherein the bevel has an angle, β, selected such that when the base has zero deflection, the bevel angle β satisfies the relations:

$$K''_0 = (\cos^2\beta + K_{0r}\sin^2\beta)\left[1 + \cot\beta\left(\tan\delta - \frac{\tan\beta(1 - K_{0r})}{1 + K_{0r}\tan^2\beta}\right)\right]$$

$$K_{b0} = (\cos^2\beta + K_{0r}\sin^2\beta)\left[-\cot\beta + \tan\delta - \frac{\tan\beta(1 - K_{0r})}{1 + K_{0r}\tan^2\beta}\right]$$

$$K_{0r} = \frac{\cos^2\phi}{z_0^2 - z_m^2}[A_1(1 - z_m^2) - 4A_2(1 - z_m) + 2\ln z_0 - 2A_3\ln z_m]$$

where, $A_1=[1+\tan(\phi-\epsilon)\tan\phi]^2$ $A_2=\tan\phi\tan(\phi-\epsilon)[1+\tan(\phi-\epsilon)\tan\phi]$ $A_3=\tan^2\phi\tan^2(\phi-\epsilon)$ $z_0=1+\sin\phi\sqrt{1-\cot\phi\tan\epsilon}$ $z_m=\sin\phi\sqrt{1-\cot\phi\tan\epsilon}$ $K''_0$=At rest pressure coefficient at bevel at heel;

$K_{b0}$=Vertical at rest pressure coefficient at bevel at heel;

$K_{0r}$=At rest coefficient for a sloped backfill;

β=180−β'=bevel angle;

α=local slip surface at the bevel;

δ=concrete friction angle with soil at the bevel;

ϕ=internal friction angle of the soil; and

ϵ=is the angle of the backfill behind the retaining wall.

2. The retaining wall of claim 1, wherein the base section includes a number of piles that extend downwardly from the base section.

3. The retaining wall of claim 1, wherein the base section includes a key that runs continuously along a bottom surface of the base section.

4. The retaining wall of claim 3, wherein the key is beveled.

5. The retaining wall of claim 1, wherein the base section includes a toe portion that extends horizontally outwards from the base of the stem wall section in a direction opposite to the heel portion.

6. A retaining wall, comprising:

a vertical stem wall section;

a base section positioned below the vertical stem wall section wherein the base section includes a heel portion that extends horizontally outwards from the stem wall section, wherein the base section has a first portion of a top surface that is oriented at a first angle with respect to the vertical stem wall section of the retaining wall and a second portion of the top surface that forms a bevel that is oriented at a second, steeper angle with respect to the vertical stem wall section, wherein the base section further includes a number of shallow piles that extend downwardly from the base section; and wherein the bevel has an angle, β, selected such that when the base has zero deflection, the bevel angle β satisfies the relations:

$$K_0'' = (\cos^2\beta + K_{0r}\sin^2\beta)\left[1 + \cot\beta\left(\tan\delta - \frac{\tan\beta(1 - K_{0r})}{1 + K_{0r}\tan^2\beta}\right)\right]$$

$$K_{b0} = (\cos^2\beta + K_{0r}\sin^2\beta)\left[-\cot\beta + \tan\delta - \frac{\tan\beta(1 - K_{0r})}{1 + K_{0r}\tan^2\beta}\right]$$

$$K_{0r} = \frac{\cos^2\phi}{z_0^2 - z_m^2}[A_1(1 - z_m^2) - 4A_2(1 - z_m) + 2\ln z_0 - 2A_3\ln z_m]$$

where, $A_1=[1+\tan(\phi-\epsilon)\tan\phi]^2$ $A_2=\tan\phi\tan(\phi-\epsilon)[1+\tan(\phi-\epsilon)\tan\phi]$ $A_3=\tan^2\phi\tan^2(\phi-\epsilon)$ $z_0=1+\sin\phi\sqrt{1-\cot\phi\tan\epsilon}$ $z_m=\sin\phi\sqrt{1-\cot\phi\tan\epsilon}$ $K''_0$=At rest pressure coefficient at bevel at heel;

$K_{b0}$=Vertical at rest pressure coefficient at bevel at heel;

$K_{0r}$=At rest coefficient for a sloped backfill;

β=180−β'=bevel angle;

α=local slip surface at the bevel;

δ=concrete friction angle with soil at the bevel;

ϕ=internal friction angle of the soil; and

ϵ=is the angle of the backfill behind the retaining wall.

7. The retaining wall of claim 6, wherein the base section includes a toe portion that extends horizontally outwards from the stem wall section.

8. A counterfort retaining wall, comprising:

a vertical stem wall section;

a base section positioned below the stem wall section wherein the base section includes a heel portion that extends horizontally outwards from the stem wall section and wherein the heel portion has an outer vertical edge at an end of the heel portion, a top surface and a bevel at an outer end of the heel portion, wherein the bevel has a first edge that meets an upper end of the outer vertical edge and a second edge that is positioned on the top surface between the outer vertical edge and the vertical stem wall section; and one or more intermediate columns or vertical beams that support the stem wall section or the base section or both, wherein the bevel has an angle, β, selected such that when the base has zero deflection, the bevel angle β satisfies the relations:

$$K_0'' = (\cos^2\beta + K_{0r}\sin^2\beta)\left[1 + \cot\beta\left(\tan\delta - \frac{\tan\beta(1 - K_{0r})}{1 + K_{0r}\tan^2\beta}\right)\right]$$

$$K_{b0} = (\cos^2\beta + K_{0r}\sin^2\beta)\left[-\cot\beta + \tan\delta - \frac{\tan\beta(1 - K_{0r})}{1 + K_{0r}\tan^2\beta}\right]$$

$$K_{0r} = \frac{\cos^2\phi}{z_0^2 - z_m^2}[A_1(1 - z_m^2) - 4A_2(1 - z_m) + 2\ln z_0 - 2A_3\ln z_m]$$

where, $A_1=[1+\tan(\phi-\epsilon)\tan\phi]^2$ $A_2=\tan\phi\tan(\phi-\epsilon)[1+\tan(\phi-\epsilon)\tan\phi]$ $A_3=\tan^2\phi\tan^2(\phi-\epsilon)$ $z_0=1+\sin\phi\sqrt{1-\cot\phi\tan\epsilon}$ $z_m=\sin\phi\sqrt{1-\cot\phi\tan\epsilon}$ $K''_0$=At rest pressure coefficient at bevel at heel;

$K_{b0}$=Vertical at rest pressure coefficient at bevel at heel;

$K_{0r}$=At rest coefficient for a sloped backfill;

β=180−β'=bevel angle;

α=local slip surface at the bevel;

δ=concrete friction angle with soil at the bevel;

ϕ=internal friction angle of the soil; and

ϵ=is the angle of the backfill behind the retaining wall.

9. The retaining wall of claim 8, wherein the base section includes a number of piles that extend downwardly from the base section.

10. The retaining wall of claim 8, wherein the base section includes a key that runs continuously along a bottom surface of the base section.

11. The retaining wall of claim 10, wherein the key is beveled.

12. The retaining wall of claim 8, wherein the base section includes a toe portion that extends horizontally outwards from the stem wall section.

13. A counterfort retaining wall, comprising:

a vertical stem wall section;

a base section positioned below the vertical stem wall section wherein the base section includes a heel portion that extends horizontally outwards from the stem wall section, the heel including an outer vertical edge at an end of the heel portion, a top surface and a bevel surface at the outer top surface of the heel portion, wherein the bevel surface is sloped at a steeper angle with respect to the vertical stem wall than a portion of the top surface that is positioned between the bevel surface and the vertical stem wall section, and wherein the base section includes a number of shallow piles that extend downwardly from the base section; and one or more intermediate columns or vertical beams that support the stem wall section or the base section or both, wherein the bevel has an angle, β, selected such that when the base has zero deflection, the bevel angle β satisfies the relations:

$$K_0'' = (\cos^2\beta + K_{0r}\sin^2\beta)\left[1 + \cot\beta\left(\tan\delta - \frac{\tan\beta(1 - K_{0r})}{1 + K_{0r}\tan^2\beta}\right)\right]$$

$$K_{b0} = (\cos^2\beta + K_{0r}\sin^2\beta)\left[-\cot\beta + \tan\delta - \frac{\tan\beta(1 - K_{0r})}{1 + K_{0r}\tan^2\beta}\right]$$

$$K_{0r} = \frac{\cos^2\phi}{z_0^2 - z_m^2}[A_1(1 - z_m^2) - 4A_2(1 - z_m) + 2\ln z_0 - 2A_3\ln z_m]$$

where, $A_1=[1+\tan(\phi-\epsilon)\tan\phi]^2$ $A_2=\tan\phi\tan(\phi-\epsilon)[1+\tan(\phi-\epsilon)\tan\phi]$ $A_3=\tan^2\phi\tan^2(\phi-\epsilon)$ $z_0=1+\sin\phi\sqrt{1-\cot\phi\tan\epsilon}$ $z_m=\sin\phi\sqrt{1-\cot\phi\tan\epsilon}$ $K''_0$=At rest pressure coefficient at bevel at heel;

$K_{b0}$=Vertical at rest pressure coefficient at bevel at heel;

$K_{0r}$=At rest coefficient for a sloped backfill;

$\beta=180-\beta'$=bevel angle;

α=local slip surface at the bevel;

δ=concrete friction angle with soil at the bevel;

φ=internal friction angle of the soil; and

ϵ=is the angle of the backfill behind the retaining wall.

14. The retaining wall of claim 13, wherein the base section includes a toe portion that extends horizontally outwards from the stem wall section.

* * * * *